US005620823A

United States Patent [19]

Kambayashi et al.

[11] Patent Number: 5,620,823

[45] Date of Patent: Apr. 15, 1997

[54] DEVELOPING AGENT FOR ELECTROPHOTOGRAPHY AND DEVELOPING METHOD

[75] Inventors: Akira Kambayashi, Tokyo; Yukio Koizumi; Shigeyuki Kuroiwa, both of Kawasaki, all of Japan

[73] Assignee: Kabushiki Kaisha Toshiba, Kawasaki, Japan

[21] Appl. No.: 551,728

[22] Filed: Nov. 1, 1995

[30] Foreign Application Priority Data

Nov. 30, 1994 [JP] Japan ..... 6-296602

[51] Int. Cl.[6] ..... G03G 13/08; G03G 9/097

[52] U.S. Cl. ..... 430/102; 430/110; 430/111; 430/903

[58] Field of Search ..... 430/102, 110, 430/111, 903

[56] References Cited

U.S. PATENT DOCUMENTS

| | | | |
|---|---|---|---|
| 4,985,327 | 1/1991 | Sakashita et al. | 430/110 |
| 4,987,454 | 1/1991 | Natsuhara et al. | 355/259 |
| 5,009,973 | 4/1991 | Yoshida et al. | 430/111 |
| 5,120,631 | 6/1992 | Kanbayashi et al. | 430/111 |
| 5,137,796 | 8/1992 | Takiguchi et al. | 430/111 |
| 5,155,532 | 10/1992 | Sakurada et al. | 430/111 |
| 5,328,792 | 7/1994 | Shigemori et al. | 430/903 |

*Primary Examiner*—Roland Martin
*Attorney, Agent, or Firm*—Foley & Lardner

[57] ABSTRACT

A developing agent for electrophotography which comprises toner particles containing a resin binder and a colorant. The toner particles include which have diameter of 5 μm or less and which account for less than 10% by number of all particles, and include particles which have diameter of 20 μm or more and which account for less than 0.5% by weight, and the weight average standard deviation in particle diameter of the toner particles is 2.5 μm or less. The developing agent may further contain an external additive comprising small silica particles 6 nm to less than 18 nm in average primary particle diameter and large silica particles 18 nm to less than 46 nm in average primary particle diameter.

18 Claims, 4 Drawing Sheets

DEVELOPING AGENT FOR ELECTROPHOTOGRAPHY AND DEVELOPING METHOD

BACKGROUND OF THE INVENTION

1. Field of the Invention

This invention relates to a developing agent for electrophotography to be used for forming a visualized image of an electrostatic latent image, and a developing method using the developing agent.

2. Description of the Related Art

There have been proposed a large number of electrophotography methods up to date. However, the electrophotography method is typically performed in the following procedures. Namely, first, an electrostatic latent image is reproduced on a photosensitive drum comprising a body of a photoconductive material. Then, a developing agent is electrostatically adhered to the photosensitive drum in conformity with the electrostatic latent image thereby developing the latent image, thus forming a developing agent image. The image thus formed with the developing agent is transferred to a transfer medium such as a sheet of paper, and finally fixed thereon by means of heat and pressure, or by using a solvent vapor.

In order to precisely visualize the latent image reproduced on a photosensitive drum, the toner particles constituting the developing agent are required to be sufficiently and uniformly electrified by way of friction. In a non-magnetic single-component developing process, the following measures are generally taken in order to uniformly electrifying individual toner particles. Namely, the formation of developing agent layer as well as the electrification of developing agent are controlled by pressing a layer-regulating blade down to a layer of the developing agent which has been retained on a developing roller.

In the developing process using a non-magnetic single-component developing agent, the chance of the toner particles being electrified is very limited due to the construction of its developing apparatus as compared with the developing process using a binary component developing agent comprising carrier particles and toner particles. Specifically, in the developing process using a non-magnetic single-component developing agent, the stage wherein the electrification can be most directly applied to the toner particles is the moment when the toner particles on the sleeve of the developing roller pass through the layer-regulating blade. Therefore, if the toner particles are not sufficiently rubbed at this moment of passing through the layer-regulating blade, an insufficient electrification of the toner particles will be resulted, thereby giving rise to the generation of fogging on photosensitive drum.

There has been proposed measures of lowering the flowability of toner in the non-magnetic single-component developing process in an attempt to reduce the fogging on a photosensitive drum. However, when the flowability of the toner is lowered, it gives rise to another problem of a blur in image in the latter half portion of the solid image.

As explained above, in spite of serious problem that will be brought about by the fogging on a photosensitive drum, there has been failed as yet to find a suitable means for reducing the fogging on a photosensitive drum without raising such a new problem.

U.S. Pat. No. 4,987,454 discloses that use is made of toner particles which have at most 12 μm of 50% average particle diameter, at least 16 μm particles in an amount of 10% or less, and a coefficient of variation {(standard deviation/50% average particle diameter)×100% } in a value of 20% or less. However, the aforementioned problems have not yet been solved in a single-component development process.

SUMMARY OF THE INVENTION

An object of the present invention is to provide a developing agent for electrophotography which is capable of inhibiting the generation of fogging on a photosensitive drum.

Another object of the present invention is to provide a method of developing an electrostatic latent image which is capable of inhibiting the generation of fogging on a photosensitive drum.

Namely, according to this invention, there is provided a developing agent for electrophotography which comprises toner particles containing a resin binder and a colorant, the toner particles including first particles which have diameter of 5 μm or less and which account for less than 10% by number of all particles, and second particles which have diameter of 20 μm or more and which account for less than 0.5% by weight, and a weight average standard deviation in particle diameter of the toner particles being 2.5 μm or less.

According to this invention, there is also provided a developing agent for electrophotography which comprises toner particles containing a resin binder and a colorant, and silica particles, the toner particles including first particles which have diameter of 5 μm or less and which account for less than 10% by number of all particles, and second particles which have diameter of 20 μm or more and which account for less than 0.5% by weight, a weight average standard deviation in particle diameter of the toner particles being 2.5 μm or less, and the silica particles comprising first silica particles having an average primary particle diameter ranging from 6 nm to less than 18 nm and second silica particles having an average primary particle diameter ranging from 18 nm to less than 46 nm.

According to this invention, there is further provided a developing method which comprises the steps of; feeding a developing agent comprising toner particles containing a resin binder and a colorant onto a developing means provided so as to face a photo-receptor on which an electrostatic latent image is formed, the toner particles including first particles which have diameter of 5 μm or less and which account for less than 10% by number of all particles, and second particles which have diameter of 20 μm or more and which account for less than 0.5% by weight, and a weight average standard deviation of the diameters of the toner particles in a value of 2.5 μm or less, frictionally electrifying the developing agent by a developing agent layer-regulating member provided so as to contact with the developing agent fed on the developing means in the step of feeding a developing agent, thereby forming an electrified developing agent layer on the developing means, and developing the latent image by the electrified developing agent layer formed in the step of forming an electrified developing agent layer.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

The toner particles constituting the developing agent of this invention are formulated such that larger particles having a particle diameter of 20 μm or more as well as smaller particles having a particle diameter of 5 μm or less are respectively controlled to less than a predetermined amount, thereby avoiding any possibility that the developing agent contains a large amount of extremely large or extremely small particles. Moreover, since a weight average standard deviation in particle diameter of the toner particles is controlled to 2.5 μm or less, the variability in particle diameter of the toner particles is further restricted. When the toner particles restricted in variability of particle diameter are frictionally electrified by means of a developing agent layer-regulating blade, each of the toner particles can be uniformly frictionally electrified.

Furthermore, the developing agent of this invention is also featured in that it may contain two kinds of silica each differing in average diameter as an external additive in addition to afore-mentioned feature of restricted variability in particle diameter as explained above. In this case, it is possible not only to prevent the fogging on the photosensitive body, but also to improve the flowability of the toner particles.

This invention will be further explained in detail with reference to the following examples.

Example 1

Figure 1:
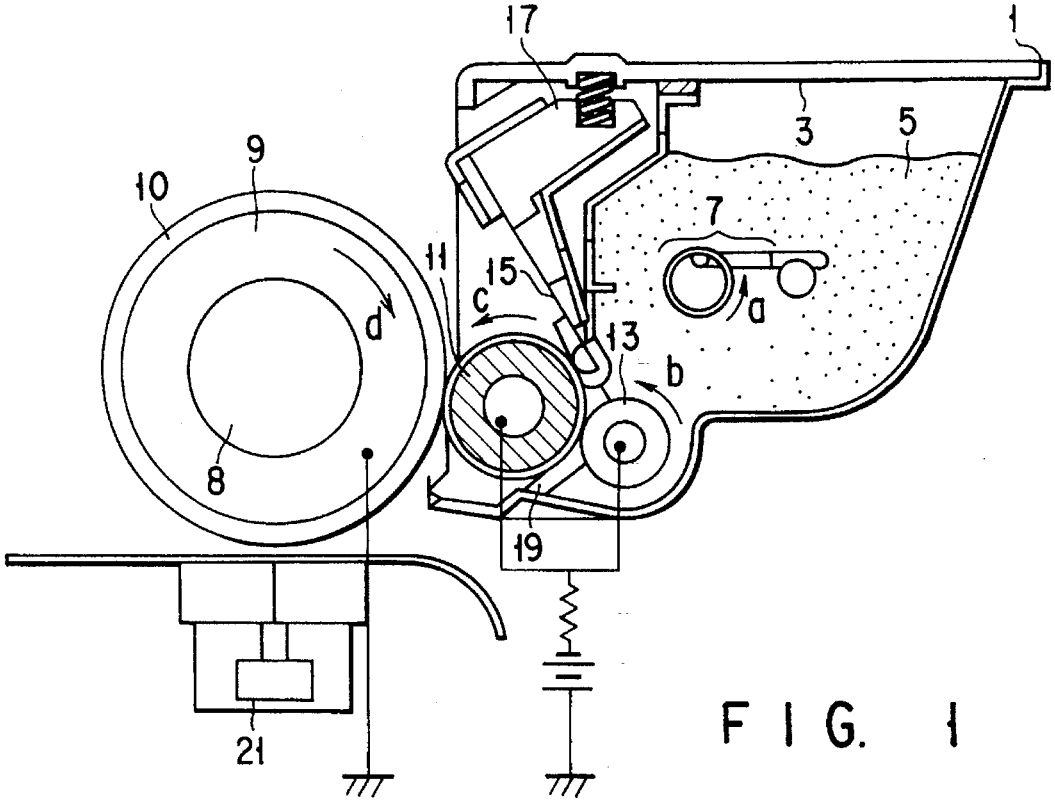
FIG. 1 is a sectional view of a developing apparatus to which the developing agent of the present invention can be applied.

FIG. 1 shows a sectional view of a developing apparatus to which the developing agent of the present invention can be applied.

This developing apparatus is constructed as follows. Namely, a toner vessel 3 (hereinafter referred to simply as vessel 3) for receiving a non-magnetic toner 5 (hereinafter referred to simply as toner 5) is housed in the main body 1 of the developing apparatus (hereinafter referred to simply as main body 1). Further, inside the vessel 3 are disposed a mixer 7 for stirring the toner 5, and a feed roller 13 for feeding the stirred developing agent to a developing roller 11. The mixer 7 and feeding roller 13 are made free to rotate in the direction indicated by the arrows 'a' and 'b' respectively. The developing roller 11 is covered with a member made of conductive and elastic material, and arranged to face to a photosensitive drum 9.

The photosensitive drum 9 comprises a rotatable body 8 and a negatively charged organic photosensitive material 10 covering the surface of the rotatable body 8, and is connected to a ground. When a laser depicting an original image as an optical signal is irradiated onto the surface of the organic photosensitive material 10, an electrostatic latent image is formed on the surface of the photosensitive material.

Meanwhile, a blade 15 held by a blade holder 17 is disposed over the developing roller 11. This blade 15 functions to control the amount of the developing agent to be fed to the developing roller 11, and at the same time functions to frictionally electrify the developing agent. On the other hand, below the developing roller 11 is disposed a recovery blade 19 which functions to collect the residual portion of the developing agent that has not been used for the development of the latent image and remained on the surface of the developing roller 11, the collected developing agent being put back to the vessel 3.

Further, at the downstream side of the rotating direction of the photosensitive drum 9 is disposed a transfer device 21 for transferring the developing agent that has been formed on the surface of the organic photosensitive material 10 to a transfer medium such as a sheet of paper.

A developing process using the developing apparatus constructed as mentioned above can be performed in the following way. First, the developing agent 5 in the vessel 3 is transferred to over the feeding roller 13 while being stirred with the mixer 7. Then, the developing agent 5 is further transferred from the feeding roller 13 onto the developing roller 11. The developing agent 5 thus transferred is then regulated of its feeding amount by means of the blade 15 thereby forming a thin layer of the developing agent 5 on the surface of the developing roller 11. At the same time, the layer of the developing agent retained on the developing roller 11 is flattened by the blade 15. As a result of this flattening action of the blade 15, a friction is caused between the thin layer of the developing agent and the blade 15, thereby electrifying the developing agent.

The surface of the negatively charged organic photosensitive body 10 constituting the photosensitive drum 9 is uniformly electrified generally at about −500 v to −550 v. When the image of an original is irradiated as an optical image onto the organic photosensitive body 10 thus charged, the resistance of the irradiated portion on the photosensitive body 10 is decreased thereby allowing the electric charge of this irradiated portion to be passed on to the ground. As a result, the surface potential of the organic photosensitive body is decreased to approximately 0 v thereby allowing an electrostatic latent image to be formed. The reverse development is a system wherein the development is performed by adhering a developing agent onto the electrostatic latent image. Therefore, in this case, a negatively electrified developing agent is employed. Accordingly, when the developing roller 11 having on its surface a thin layer of negatively charged developing agent is rotated in a direction in reverse to the rotating direction of the photosensitive drum 9, the thin layer formed on developing roller 11 is frictionally contacted to the surface of the organic photosensitive body 10 due to the elastic force of the developing roller 11. With this mechanical force as well as owing to the electrostatic adsorptive force between the electric charge on the surface of the photosensitive body and the electric charge of the developing agent, the developing agent is caused to adhere onto the electrostatic latent image thereby performing the development process.

Meanwhile, the copying machine including the main body 1 is provided with a paper-feeding tray (not shown) for feeding a sheet of transfer paper. This transfer paper supplied from the paper-feeding tray is introduced as a transfer medium into a space between the photosensitive drum 9 and the transfer device 21 for receiving the developing image formed by the developing process. When an electric charge having the same polarity as that of the developing agent is applied to the back surface of the transfer paper from the transfer device 21, the developing image formed on the photosensitive body is transferred onto the sheet of transfer paper by the effect of electrostatic force. On the other hand, a residual portion of developing agent 5 which has been fed by the developing roller 11 but not used in the developing process is collected by the action of the recovery blade 19 into the vessel 3.

The developing agent to be used in this developing apparatus as explained above can be manufactured for example as follows.

First, a mixture comprising resin binder, colorant, wax and a charge control agent in a prescribed ratio are mixed and homogenized using a ball mill or a V-shaped mixer. Then, the resultant mixture is melted and thermally kneaded with a press kneader or roll. The kneaded produced thus obtained is then granulated by using a hammer mill or a jet mill, and subsequently further pulverized into fine powder by using a jet mill for example. Subsequently, the pulverized mixture is classified into a predetermined grain size by using a pneumatic classifier, thereby obtaining a toner particle useful for constituting the developing agent of this invention.

By controlling conditions, for example, classifying conditions of the classifier, the toner particle having desired particle size can be obtained.

If the weight average grain diameter of the toner particle exceeds over 12 μm, the resolving power will be deteriorated so that it is preferable to control the weight average grain diameter of the toner particle to 12 μm or less.

In this example, 92 parts by weight of polyester, 4 parts by weight of carbon black, 2 parts by weight of polypropylene wax and 2 parts by weight of charge control agent were thermally kneaded to obtain a mixture, which was subsequently cooled. The resultant mixture was then granulated with a hammer mill, pulverized with a jet mill, and finally classified to obtain toner particles. When this toner particle were measured of their grain size, the toner particles contained 5.8% by particle number of particles which are 5 μm or less in particle diameter, and 0.2% by weight of particles which are 20 μm or more in particle diameter, and the weight average standard deviation in particle diameter of the toner particles was found to be of 2.1 μm. Meanwhile, the weight average diameter of the toner particles was about 10 μm.

It is preferable for the developing agent of this invention to be added with two kinds of hydrophobic silica each differing in average diameter as an additive. In this example, a mixture consisting of a small grain silica 16 nm in primary grain diameter to a large grain silica 30 nm in primary grain diameter in the ratio of 3:2 was added to the toner particles.

Now, the measuring method of the grain diameter of toner as well as the measuring method of the fogging of the photosensitive body will be explained as follows.

As a measuring apparatus for measuring the grain diameter and standard deviation of toner, Coulter counter-TA-II (Coulter Co., Ltd. ) was employed. To this measuring apparatus, an interface and a personal computer (Epson Co., Ltd. ) were connected for obtaining the distribution of average particle number and the distribution of average weight. A 1% aqueous solution of NaCl prepared by using extra pure sodium chloride was used as an electrolyte.

Before performing the measurements, a surfactant, preferably 1.0 to 5 ml of alkylbenzene sulfonate was added as a dispersant to 100 to 150 ml of the aqueous solution of the electrolyte, and then 0.5 to 50 ml of the toner as a measuring sample was added to this mixed electrolyte solution thereby obtaining a suspended solution of the measuring sample. This suspended solution was then subjected to dispersing treatment for about 5 to 10 minutes by using an ultrasonic dispersing apparatus. Subsequently, the grain distribution of 2 to 40 μm particles was measured using a 100 μm aperture in the measurement with the Coulter counter-TA-II, and the distribution of average particle number and the distribution of average weight were calculated.

The fogging on the photosensitive body was measured in the following manner.

The electric source of the copying apparatus was turned on to start the printing of a test chart, and immediately after the transferring of a developing agent image formed on the photosensitive body (drum) onto a sheet of paper was started, the electric source was turned off. Then, a piece of mending tape (a product of Sumitomo 3M Co., Ltd. ) was adhered over a developing agent image formed on the photosensitive body immediately before the developing agent image was transferred onto a sheet of paper. Then, the piece of the tape was peeled off from the photosensitive body and adhered again onto a sheet of white paper. For the purpose of comparison, a piece of the mending tape was directly adhered onto the same white paper. Subsequently, the reflectivity of white ground portion of these two pieces of tape adhered on the white paper was measured using a color-difference meter (a product of Minolta Co., Ltd. ). The fogging on the photosensitive body was calculated from the reflectance difference thus measured.

The flowability of the developing agent was evaluated by measuring the amount of the developing agent remaining on a 200 mesh sieve by using a powder tester (a product of Hosokawa Micron Co., Ltd. ).

When the developing agent of Example 1 which was remaining on a 200 mesh sieve was measured in accordance with the method explained above, the amount of the developing agent was found to be 6.7 g, indicating an excellent flowability.

Further, the developing agent of Example 1 was used for a development using the developing apparatus shown in FIG. 1, and the fogging on the photosensitive body, the image concentration, the fogging on paper and the solid fidelity of the resultant image were checked. In this test, the measurement of the fogging on the photosensitive body was performed by sampling the developing agent under two different environmental conditions as shown in Table 1, and the formation of images was conducted by using developing agents which had been left under these conditions for 16 hours.

TABLE 1

| | Temp. (°C.) | Relative Humid. (% RH) |
|---|---|---|
| Condition A | 25 | 50 |
| Condition B | 30 | 85 |

As a result, an image concentration of 1.45 was obtained in either of the environmental conditions A and B, the fogging on paper in the environmental conditions A and B was found to be 0.22% and 0.25% respectively, and the fogging on the photosensitive body in the environmental conditions A and B was found to be 0.83% and 1.26% respectively.

Further, when the solid fidelity of the resultant image were checked through visual observation, excellent solid fidelity thereof was observed in either of the environmental conditions.

The reason for these excellent results obtained through the use of the developing agent of this invention can explained as follows. Namely, when the toner particles constituting a developing agent has a relatively wide particle size distribution, there will be inevitably existed two kinds of toner particles whose grain size is extremely differs from each other, viz. large toner particles whose diameter are larger than the space between the developing sleeve and the layer-regulating blade, and small toner particles whose diameter are extremely smaller than the space between the developing sleeve and the layer-regulating blade. These large toner particles will be naturally widening the space between the developing sleeve and the layer-regulating blade, as these large toner particles pass through the space. Whereas these small toner particles would be insufficiently rubbed as they pass through the space between the rotating developing sleeve and the layer-regulating blade. In particular, when the large toner particles are present in a developing agent, the amount of toner particles which fail to be frictionally electrified sufficiently would be increased in addition to the extremely small toner particles, thus giving rise to the increased possibility of non-uniform electrification and the generation of the fogging on a photosensitive body.

Figure 2:
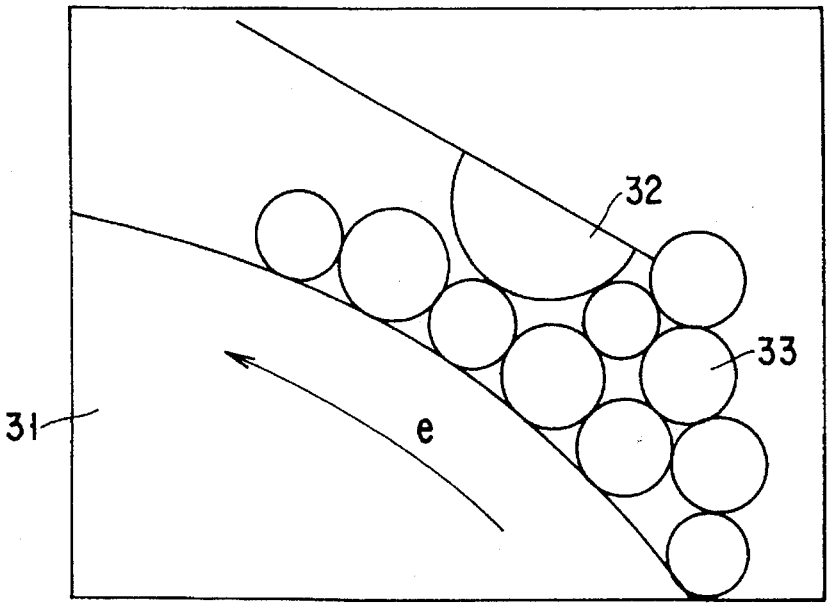
FIG. 2 is a schematical view illustrating the state of the developing agent of the present invention when the developing agent passes through the layer-regulating blade.

FIG. 2 depicts schematical view of the state of the developing agent of this invention when the developing agent passes through the layer-regulating blade. As shown in FIG. 2, since the toner particles 33 are confined such that extremely small and extremely large particles are excluded and the distribution of grain size is narrowed, the toner particles 33 can be sufficiently frictionally electrified as they pass through the space between the developing sleeve 31 rotating in the direction of an arrow 'e' and the layer-regulating blade 32.

Figure 3:
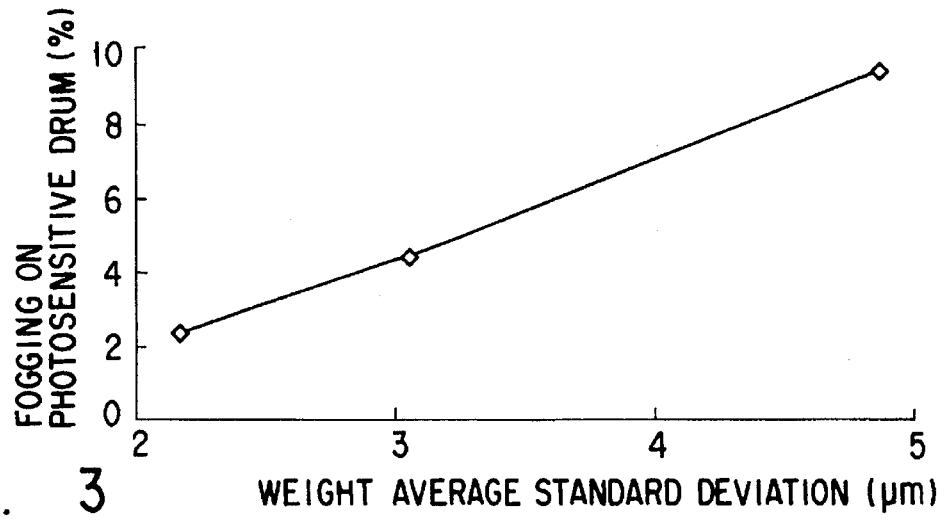
FIG. 3 is a graph showing the relationship between a weight average standard deviation in particle diameter of a toner contained in the developing agent of the present invention and the fogging on a photosensitive drum.

FIG. 3 shows the relationship between a weight average standard deviation in particle diameter of a toner and the fogging on a photosensitive drum. As seen from this FIG. 3, the fogging on a photosensitive drum becomes more conspicuous as a weight average standard deviation in particle diameter of a toner increases. However, since the weight average standard deviation of the toner particles constituting the developing agent is confined to 2.5 μm or less in this invention, the generation of fogging on a photosensitive drum can be inhibited.

Moreover, since the amounts of toner particles 5 μm or less and toner particles 20 μm or more are confined to a prescribed range in addition to the confinement of the weight average standard deviation of the toner particles to a specific range as mentioned above, it is now possible to prevent the dropping of the toner particles and at the same time to avoid the generation of the fogging on a photosensitive drum.

This phenomenon can be explained as follows. Namely, small toner particles 5 μm or less in diameter are more influenced by Van der Waals force rather than by Coulomb force in an electrophotographic process, so that these small toner particles are more likely to be adhered to a material coming within Van der Waals radius irrespective of their electrification states. Therefore, when small toner particles 5 μm or less in diameter are brought close to a photosensitive drum, the small toner particles are forced to adhere to even a non-image portion of a photosensitive drum irrespective to the potential of the surface of the photosensitive drum, thus resulting in the generation of fogging on the photosensitive drum. On the other hand, large toner particles 20 μm or more in diameter causes the expansion of opening space between a layer-regulating blade and a developing sleeve as they pass through the layer-regulating blade, thus giving rise to the enlargement of non-uniformity in electrification of toner particles as a whole and also the generation of fogging on the photosensitive drum. Moreover, large toner particles 20 μm or more in diameter may be easily dropped onto the surface of a transfer medium such as a sheet of paper, since the gravity of these large toner particles are generally larger than Coulomb force.

By the way, since small toner particles 5 μm or less in diameter are extremely small in gravity even through the particle number thereof is very large, the amount of the small toner particles is confined by the particle number in this invention. On the other hand, since large toner particles 20 μm or more in diameter are extremely large in individual gravity even through the particle number thereof is relatively small, the amount of the large toner particles is confined by the weight in this invention.

In addition to these limitation on grain size, the developing agent of this invention is featured in that two kinds of hydrophobic silica particles differing in grain size from each other, viz., large and small hydrophobic silica particles are added to the developing agent.

Followings are explanations on the hydrophobic silica particles differing in grain size from each other.

By the way, small silica particle is defined herein to mean hydrophobic silica grains having an average primary grain diameter of 6 to 18 nm.

Silica particle having this range of particle diameter is generally effective in improving the flowability of a developing agent and in preventing the caking of a developing agent. Namely, since the flowability of a developing agent can be improved by increasing the loading amount of small silica particle, it is possible to improve the solid fidelity and denseness of an image to be formed.

Figure 4:
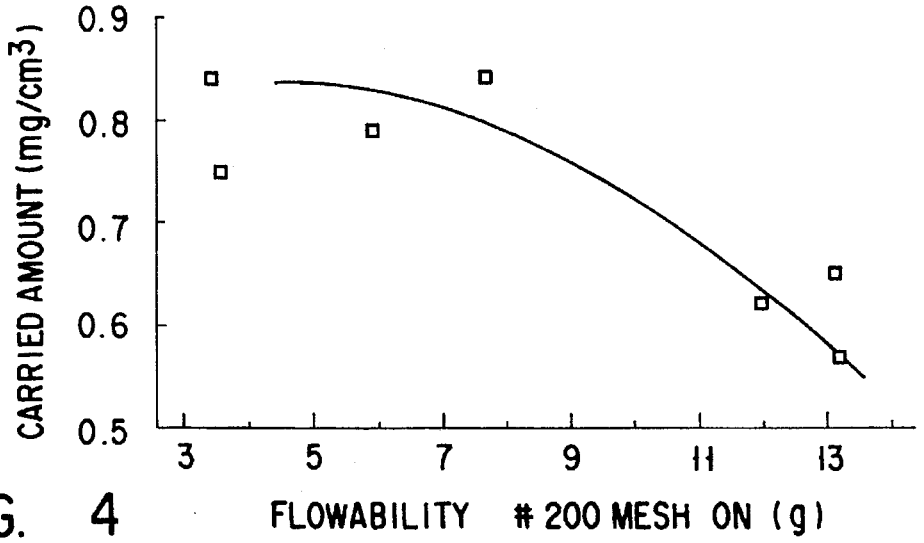
FIG. 4 is graph showing the relationship between the flowability of a developing agent and the amount of the developing agent being carried.

However, in the non-magnetic single-component developing process, the flowability of a developing agent is influenced by the carrying amount of the developing agent as shown in FIG. 4. In FIG. 4, the flowability of the developing agent is represented by the amount of the developing agent being remained on the 200 mesh sieve. Namely, when the flowability of the developing agent is improved, the amount of developing agent to be carried is proportionally increased so that the layer of developing agent is thickened. Due to this thickening of developing agent layer, the layer-regulating blade is pushed open excessively so that developing agent of small particle size can not be sufficiently rubbed, thereby giving rise to non-uniformity in electrification of toner particles thus causing the generation of fogging on a photosensitive drum.

Figure 5A:
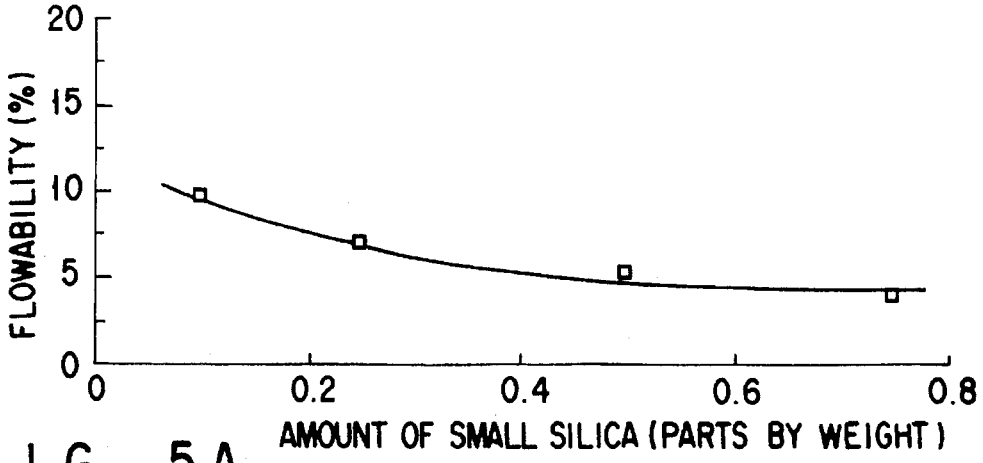
FIGS. 5A and 5B illustrate the relationships between the amount of the small silica particles and the flowability of a developing agent, and between the amount of the small silica particles and the fogging on a photosensitive body (drum)
Figure 5B:
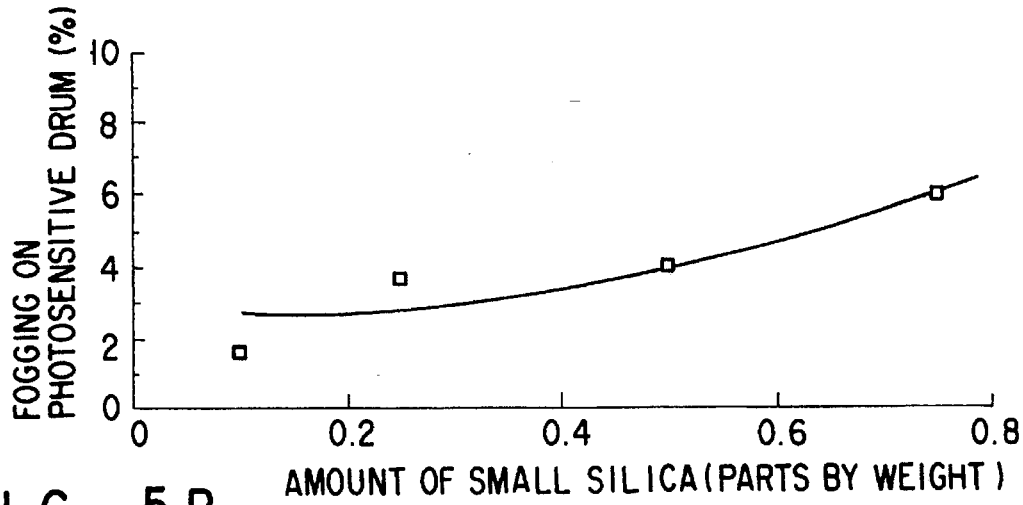

The degrees of the flowability of developing agent as well as the fogging on a photosensitive drum are dependent upon the loading amount of small silica particles. FIGS. 5A and 5B illustrate the relationships between the amount of the small silica particles and the flowability of a developing agent, and between the amount of the small silica particles and the fogging on a photosensitive body (drum). As shown in FIG. 5A, the flowability of developing agent can be increased or improved as the loading amount of small silica particles is increased. However, in the case of the fogging on a photosensitive drum, the fogging increases gradually as the loading amount of small silica particles is increased as shown in FIG. 5B. Accordingly, it would be clear that if it is desired to improve the flowability of a developing agent while avoiding the generation of fogging on a photosensitive drum, the addition simply of small silica particle to a developing agent is not enough.

By the way, large silica particle is defined herein to mean hydrophobic silica grains having an average primary grain diameter of 18 to 46 nm.

Silica particle having this range of particle diameter is not so effective as compared with small silica particle in improving the flowability of a developing agent. However, the addition of this large silica particle is advantageous in that it is effective in minimizing the fogging on a photosensitive drum and that it is hardly influenced by environmental fluctuation. The addition of this large silica particle is also advantageous in that it is hardly influenced by the potential fluctuation on the surface of a photosensitive drum. However, since this large silica particle is poor in flowability, it has a disadvantage that it gives an image of a poor solid fidelity.

Figure 6A:
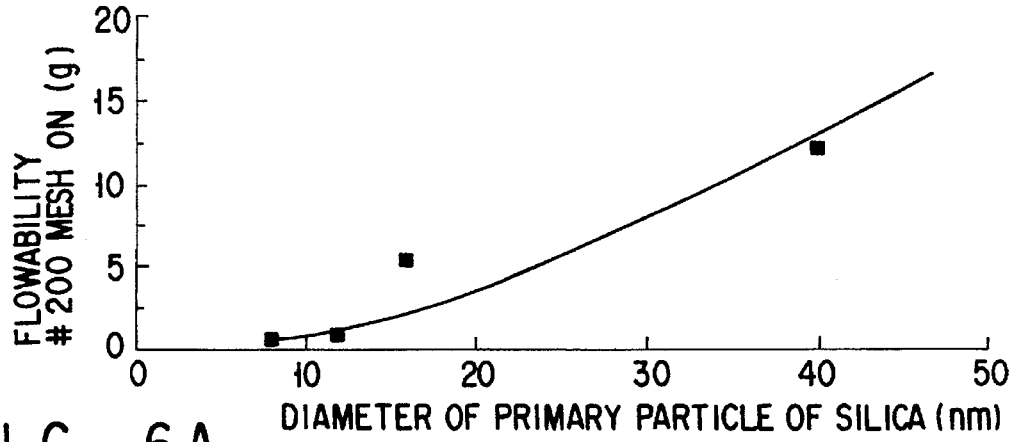
FIGS. 6A and 6B illustrate the relationships between the particle diameter of the primary particle of silica and the flowability of a developing agent, and between the particle diameter of the primary particle of silica and the fogging on a photosensitive body (drum)
Figure 6B:
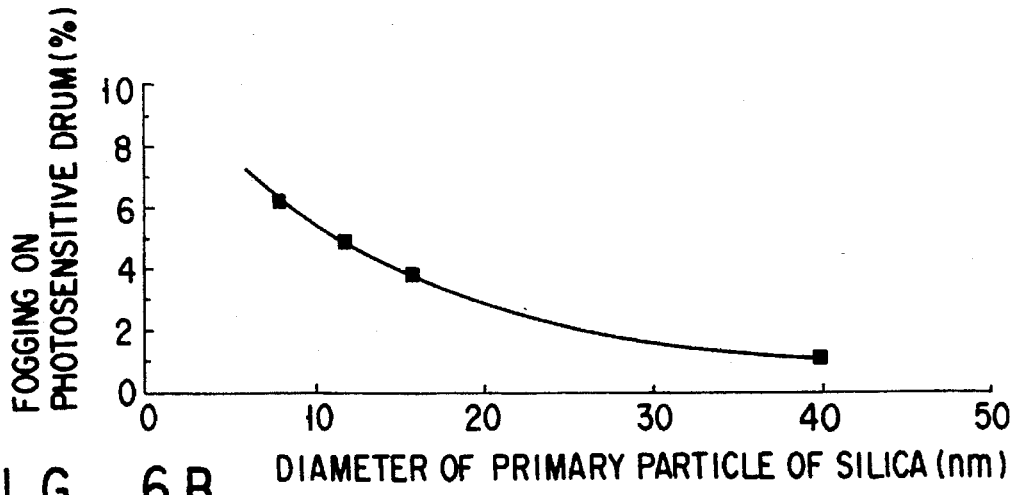

Specifically, there are relationships between the particle diameter of the primary silica particles and the flowability of a developing agent, and between the particle diameter of the primary particles of silica and the fogging on a photosensitive body as illustrated in FIGS. 6A and 6B. Namely, as the particle diameter of the primary particles of silica is increased, the flowability of a developing agent is lowered as shown in FIG. 6A. However, the fogging on a photosensitive drum is decreased as the particle diameter of the primary silica particles is increased as shown in FIG. 6B.

Figure 7:
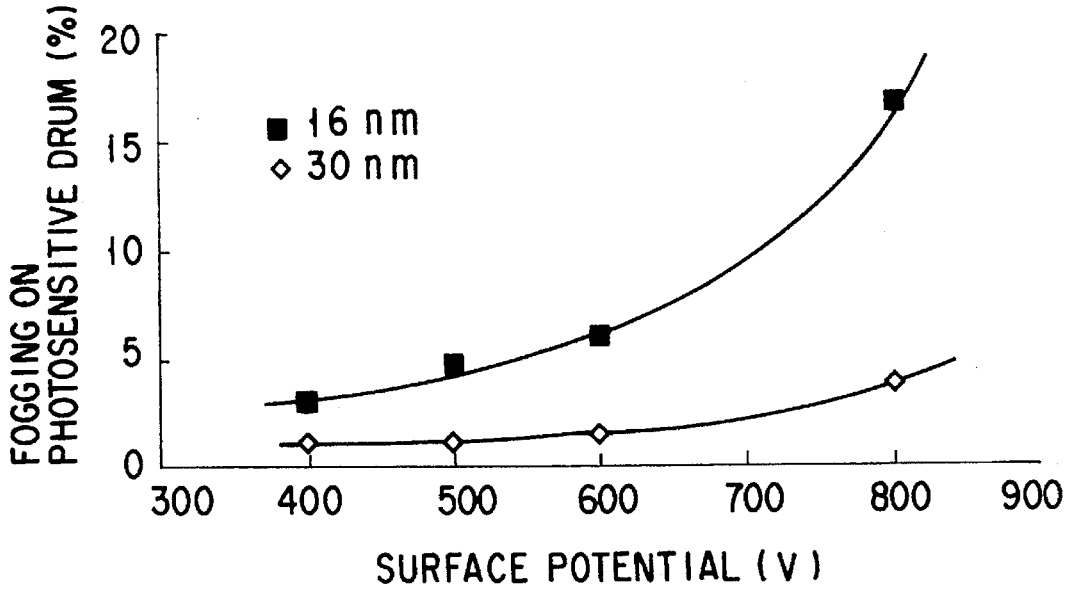
FIG. 7 illustrates the relationship between the surface potential of a developing agent and the fogging on a photosensitive body (drum)
Figure 8:
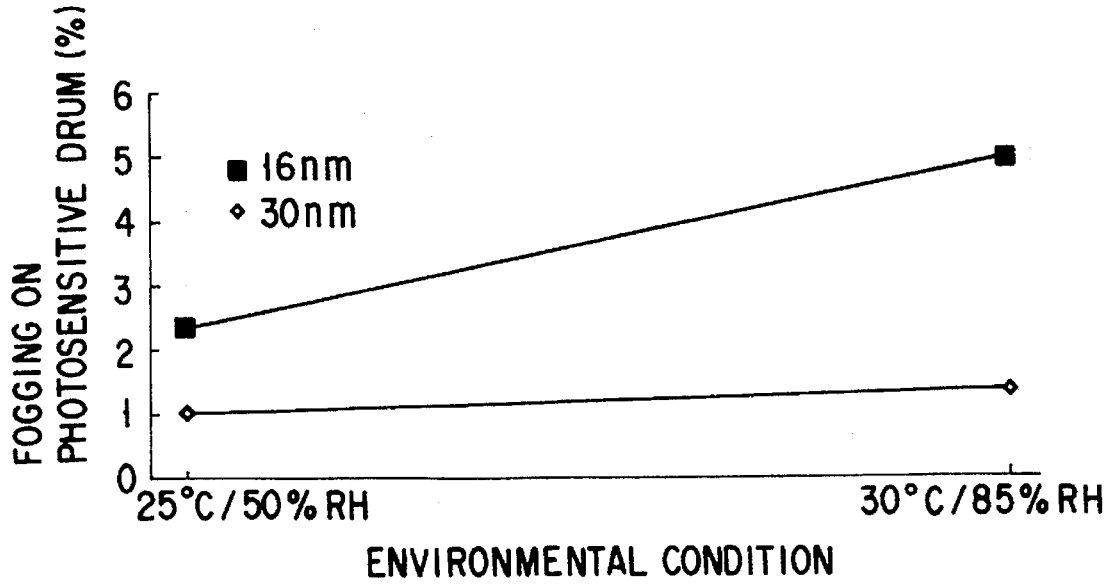
FIG. 8 is a graph showing a relationship between the environmental atmosphere and the fogging on a photosensitive body (drum)

By the way, the relationship between the surface potential of a photosensitive body and the fogging on a photosensitive body; and the relationship between the environmental fluctuation and the fogging on a photosensitive body are shown respectively in FIGS. 7 and 8. In the graphs shown in FIGS. 7 and 8, examples where both small silica particles (16 nm in particle diameter) and large silica particles (30 nm in particle diameter) were added are shown.

As shown in FIG. 7, the generation of fogging on a photosensitive drum can be controlled to minimum by using a developing agent added with large silica particles rather than using a developing agent added with small silica particles. Further, the increase in generation of fogging resulting from an increase in surface potential of the photosensitive drum can be also controlled to minimum by using a developing agent added with large silica particles rather than using a developing agent added with small silica particles. Moreover, it can be seen from FIG. 8 that the developing agent added with large silica particles are effective in controlling the generation of fogging on a photosensitive drum irrespective of a fluctuation in environment conditions.

These silica particles can be mixed with the above toner particles by any known methods, but it is preferable to employ a high-speed fluidized mixing apparatus. For example, Henschel mixer, super mixer or micro-speed mixer can be used as this high-speed fluidized mixing apparatus.

For the purpose of investigating the relationships between the particle diameter of the silica and the characteristics of developing agent added with these silica, samples of developing agent were prepared by externally adding a mixture consisting of varied mixing ratio of small silica particles 16 nm in particle diameter and large silica particles 30 nm in particle diameter to a toner. The solid fidelity of the samples was visually judged. The features of the resultant developing agent and the amount of silica are shown in Table 2. In Table 2, symbols "○", "Δ", and "×" represent levels of the solid fidelity, "good", "somewhat poor", and "poor", respectively.

TABLE 2

| | | | | | | |
|---|---|---|---|---|---|---|
| Amount of silica | 30 nm | 0.0 | 0.1 | 0.2 | 0.25 | 0.5 |
| particles | 16 nm | 0.5 | 0.4 | 0.3 | 0.25 | 0.0 |
| (parts by weight) | | | | | | |
| Flowability (g) | | 4.29 | 6.15 | 7.34 | 8.44 | 13.6 |
| Fogging (g) | | 5.9 | 3.9 | 0.6 | 0.6 | 0.7 |
| Solid fidelity | | ○ | ○ | ○ | Δ | x |

As shown in Table 2, the developing agent added only with small silica particles indicated improvement in flowability, but indicated at the same time noticeable fogging on the photosensitive drum. On the other hand, the developing agent added only with large silica particles indicated slight fogging on the photosensitive drum, but indicated at the same time a poor flowability of the developing agent thereby deteriorating the solid fidelity of an image.

Therefore, according to this invention, both small and large silica particles are mixed together and added to toner particles for preparing a developing agent in order to make good use of the advantages of these small and large silica particles and at the same time to cover up the drawbacks of these small and large silica particles. The mixing ratio of these small and large silica particles are preferably 1:8 to 8:1, more preferably 1:5 to 5:1. The total loading amount of these small and large silica particles is preferably 0.2 part by weight to 2 parts by weight, more preferably 0.4 part by weight to 1.5 parts by weight based on 100 parts by weight of a toner. Examples 2 to 6 and Control 1 to 11

A binder resin, colorant and etc. are mixed in the same manner as explained in Example 1 thereby preparing toner particles about 10 μm in a weight average particle diameter. Specifically, 92 parts by weight of polyester, 4 parts by weight of carbon black, 2 parts by weight of polypropylene wax and 2 parts by weight of charge control agent were thermally kneaded to obtain a mixture, which was subsequently cooled. The resultant mixture was then granulated with a hammer mill, pulverized with a jet mill, and finally classified to obtain toner particles. To these toners were added hydrophobic silica according to the recipe as shown in Table 3 thereby obtaining developing agents of Examples 2 to 6.

On the other hand, samples of toner particles were prepared changing the weight average standard deviation in particle diameter of a toner as well as the amounts of small particles 5 μm or less and 20 μm or more, and the toner particles thus obtained were added with hydrophobic silica according to the recipe as shown in Table 3 thereby obtaining developing agents of Controls 1 to 11.

TABLE 3

| | | Weight average SD (μm) | Weight average particle (μm) | 5 μm or less (% by particle number) | 20 μm or more (% by weight) | Silica Mix. ratio Small:Large | Silica Total amount (parts by weight) |
|---|---|---|---|---|---|---|---|
| Example | 1 | 2.1 | 10.5 | 5.8 | 0.2 | 3:2 | 0.5 |
| | 2 | 2.1 | 10.5 | 5.8 | 0.2 | 2:5 | 0.7 |
| | 3 | 2.1 | 10.5 | 5.8 | 0.2 | 3:2 | 0.5 |
| | 4 | 2.3 | 10.4 | 7.1 | 0.1 | 3:2 | 0.5 |
| | 5 | 2.4 | 10.4 | 9.4 | 0.4 | 3:2 | 0.5 |
| | 6 | 2.5 | 10.3 | 9.8 | 0.4 | 2:5 | 0.7 |
| Comparative Example | 1 | 2.6 | 10.0 | 11.2 | 0.3 | 3:2 | 0.5 |
| | 2 | 2.6 | 11.1 | 7.8 | 0.7 | 3:2 | 0.5 |
| | 3 | 3.4 | 11.5 | 8.5 | 0.4 | 3:2 | 0.5 |
| | 4 | 2.5 | 9.9 | 16.0 | 0.2 | 3:2 | 0.5 |
| | 5 | 2.5 | 11.4 | 5.4 | 0.6 | 3:2 | 0.5 |
| | 6 | 3.6 | 11.2 | 9.2 | 2.0 | 3:2 | 0.5 |
| | 7 | 4.5 | 10.8 | 13.0 | 3.B | 3:2 | 0.5 |
| | 8 | 2.1 | 10.5 | 5.8 | 0.2 | 1:0 | 0.5 |
| | 9 | 2.1 | 10.5 | 5.8 | 0.2 | 3:2 | 2.0 |
| | 10 | 2.1 | 10.5 | 5.8 | 0.2 | 1:1 | 0.1 |
| | 11 | 2.1 | 10.5 | 5.8 | 0.2 | 0:1 | 0.5 |

*Diameter of primary particle of silica
Small silica: 16 nm
Large silica: 30 nm

By the way, the weight average standard deviation in particle diameter of toners in the Controls 1 to 3, 5 and 6 was adjusted to over 2.5 μm. Further, in Control 4, the amount of toner particles 5 μm or less was adjusted to 16.0% by particle number, and in Control 5, the amount of toner particles 20 μm or more was adjusted to 0.6% by weight.

The flowability of each developing agent was evaluated by measuring the amount of the developing agent remaining on a 200 mesh sieve in the same manner as in the case of Example 1. The image concentration, the fogging on paper and so on were measured using the developing apparatus shown in FIG. 1.

The results obtained are summarized as shown in Table 4 below.

TABLE 4

| | | Image Density Env. A | Image Density Env. B | Fogging on paper (%) Env. A | Fogging on paper (%) Env. B | Fogging on photo. drum (%) Env. A | Fogging on photo. drum (%) Env. B | Solid fidelity Env. A | Solid fidelity Env. B | Flowability #200 Residue on MESH (g) |
|---|---|---|---|---|---|---|---|---|---|---|
| Example | 1 | 1.45 | 1.45 | 0.22 | 0.25 | 0.83 | 1.26 | o | o | 6.7 |
| | 2 | 1.45 | 1.45 | 0.25 | 0.29 | 0.80 | 1.33 | o | o | 6.2 |
| | 3 | 1.45 | 1.46 | 0.16 | 0.20 | 0.76 | 1.53 | o | o | 7.3 |
| | 4 | 1.46 | 1.47 | 0.28 | 0.30 | 0.90 | 1.92 | o | o | 7.1 |
| | 5 | 1.44 | 1.46 | 0.32 | 0.43 | 1.21 | 2.26 | o | o | 7.4 |
| | 6 | 1.44 | 1.45 | 0.31 | 0.38 | 1.05 | 2.03 | o | o | 8.1 |
| Comparative example | 1 | 1.43 | 1.44 | 0.42 | 0.54 | 1.66 | 2.54 | o | o | 7.8 |
| | 2 | 1.46 | 1.46 | 0.46 | 0.53 | 1.71 | 2.62 | o | o | 6.0 |
| | 3 | 1.44 | 1.45 | 0.42 | 0.51 | 4.24 | 7.38 | o | o | 4.0 |
| | 4 | 1.42 | 1.43 | 0.50 | 0.62 | 4.53 | 8.38 | o | o | 4.8 |
| | 5 | 1.45 | 1.47 | 0.38 | 0.43 | 3.66 | 6.45 | o | o | 4.1 |
| | 6 | 1.47 | 1.46 | 0.51 | 0.68 | 4.76 | 9.43 | o | o | 4.2 |
| | 7 | 1.46 | 1.46 | 0.86 | 1.15 | 18.40 | 42.67 | Δ | x | 15.8 |
| | 8 | 1.45 | 1.46 | 0.49 | 0.71 | 2.58 | 3.66 | o | o | 2.3 |
| | 9 | 1.42 | 14.3 | 0.83 | 1.31 | 3.87 | 5.27 | o | o | 1.2 |
| | 10 | 1.45 | 14.5 | 0.19 | 0.23 | 0.94 | 1.34 | Δ | Δ | 11.3 |
| | 11 | 1.44 | 14.5 | 0.14 | 0.18 | 0.67 | 1.05 | Δ | x | 13.2 |

As seen from Table 4, any of the developing agent of this invention is very low in fogging on a photosensitive drum and excellent in flowability. Accordingly, the image to be formed with the developing agent of this invention is always excellent in solid fidelity. Further, the developing agent of this invention would be generating only a permissible degree of fogging on a photosensitive drum even under high temperature and high humidity environments of for example 30° C. in temperature and 80% in relative humidity.

By contrast, the developing agents of Controls 1 to 3, 6 and 7 where the weight average standard deviation in particle diameter of toners is more than 2.5 μm showed noticeable fogging on the photosensitive drum, though some of the developing agents indicated more excellent flowability than the developing agent of this invention. In particular, these developing agents of the Controls exhibited remarkable increase in fogging on the photosensitive drum under high temperature and high humidity environments. It can be seen that this trend became more prominent as the weight average standard deviation in particle diameter of toners was increased. By the way, when the fogging on the photosensitive drum is increased, the fogging on paper also shows a trend of increase.

This trend is also seen in Control 4 where the amount of toner particles 5 μm or less is relatively large, i.e., 16.0% by particle number, and also in Control 5, where the ratio of toner particles 20 μm or more is relatively large, i.e., 0.6% by weight.

Generally, as the flowability of the developing agent increases, the fogging on the photosensitive drum increases proportionally. It has been, thus, considered difficult to increase the flowability of the developing agent while decreasing the fogging on the photosensitive drum. However, the present invention makes it possible to increase the flowability of the developing agent while keeping down the fogging on the photosensitive drum. For example, in the comparative Example 1, the value of the fogging on the photosensitive drum in the environment B, is 2.54%. In the comparative Example 2, the flowability is improved as compared to that of comparative Example 2, and reduced to 6.0 g; however the fogging on the photosensitive drum is increased to 2.62%. Similarly, in the comparative Examples, if the flowability is improved, the fogging on the photosensitive drum is deteriorated, and thus it is not possible to achieve the improvement of both characteristics at the same time.

In the present invention, as can be understood from the data of Examples 1 to 4, in the case where the flowability is improved as compared to the Comparative Example 1, the occurrence rate of the fogging on the photosensitive drum is lower than the case of the Comparative Example 1. Further, the flowability of Example 6 is relatively high as compared to those of the other Examples, but the occurrence rate of the fogging on the photosensitive drum is as low as 2.03%.

As described above, with the developing agent of the present invention, it is possible to achieve both the improvement of the flowability and the prevention of the fogging on the photosensitive drum.

This invention has been explained with reference to specific examples hereinabove, but it should be understood that this invention should never be limited to these examples.

For example, as for binder resin, homopolymer or copolymer of styrene or substituted styrene such as polystyrene, poly-p-chlorostyrene, ployvinyltoluene, styrene-p-chlorostyrene copolymer, styrene-vinyltoluene copolymer; copolymer of styrene and acrylic acid ester such as styrene-methylacrylate copolymer, styrene-ethylacrylate copolymer, styrene-n-butyl acrylate copolymer; or copolymer of styrene and methacrylic acid ester such as styrene-methylmethacrylate copolymer, styrene-ethylmethacrylate copolymer, styrene-n-butyl methacrylate copolymer may be used.

It is also possible to employ as the binder resin, styrene-based copolymer consisting of styrene and vinyl monomer, such as styrene-acrylonitrile copolymer, styrene-vinylmethyl ether copolymer, styrene-butadiene copolymer, styrene-vinylmethyl ketone copolymer, styrene-acrylonitrile indene copolymer, styrene-maleate copolymer; polymethyl methacrylate; polybutyl methacrylate; polyvinyl acetate; polyester; polyamide; epoxy resin; polyvinyl butyral; polyacrylate; phenol resin; aliphatic or alicyclic hydrocarbon; petroleum resin; and chlorinated paraffin. These resins can be used singly or in combination.

In particular, in view of improving the electrification of developing agent, it is preferable to employ polyester resin as a binder resin. For example, a polyester resin which is known as a binder resin for a dry type electrophotography can be used. Examples of such a polyester are ones which comprise dicarboxylic acid and glycol moiety, and have a softening point of 50° to 160° C., preferably 50° to 150° C., a hydroxyl number of 100 mg KOH/g or less and an acid number of 100 mg KOH/g or less. In particular, a polyester having an acid number of 30 mg KOH/g or less is more preferable, as it will provide an excellent positive electrification performance.

Such a polyester resin may be modified for improving the characteristics of toner into a compound having in its structure a three-dimensional structure by substituting part of glycol moiety and/or dicarboxylic moiety thereof by tri- or tetra-valent alcohol and/or tri- or tetra-valent carboxylic acid. Examples of alcohols useful in this case are sorbitol, hexatetrol, dipentaerythritol, glycerol and sucrose. Examples of carboxylic acids useful in this case are benzene tricarboxylic acid, cyclohexane tricarboxylic acid, naphthalene tricarboxylic acid, butane tricarboxylic acid, trimellitic acid, pyromellitic acid. It is also possible to modify such a polyester into a partially crosslinked structure or a graft polymer by introducing epoxy group or urethane linkage into glycol moiety and/or dicarboxylic moiety.

Examples of dicarboxylic moiety useful in the manufacture of such polyester resin are maleic acid, fumaric acid, mesaconic acid, citraconic acid, itaconic acid, glutaconic acid, phthalic acid, isophthalic acid, terephthalic acid, dicyclohexane dicarboxylic acid, succinic acid, adipic acid, sebacic acid, malonic acid, linolenic acid and anhydrides thereof or lower alcohol ester thereof.

Examples of glycol moiety useful in the manufacture of such polyester resin are ethylene glycol, propylene glycol, butylene glycol, neopentyl glycol, hexane diol, diethylene glycol, triethylene glycol, polyethylene glycol, dimethylol benzene, cyclohexane dimethanol, bisphenol A and hydrogenated bisphenol A.

As for colorant, carbon black, various kinds of dye and pigment may be used. Examples of the colorant are Phtharocyanine Blue, Indanthrene Blue, Peacock Blue, Permanent Red, Lake Red, Rhodamine Lake, Hansa Yellow, Permanent Yellow, Benzidine Yellow, Nigrosine dye, Aniline Blue, Alcoil Blue, Chrome Yellow, Ultramarine Blue, DuPont Oil Red, Quinoline Yellow, Methylene Blue, Malachite Green, Lamp Black, Rose Bengal, Iron Black, Ultramarine, phthalocyanine Green, Chalcoil Blue, Quinacridone and triallyl methane dye, monoazo or disazo dye or pigment. These colorants may be employed singly or in combination.

The colorants should preferably be added to the binder resin at the amount of 0.5 to 3% by weight based on the amount of a binder resin. If the amount of the colorants is less than 0.5% by weight, it would be difficult to sufficiently color the binder resin. On the other hand, if the amount of the colorants exceeds over 3% by weight, it would give bad influence to the electrification property of toner.

As an offset-preventing agent, a low molecular polyethylene and a low molecular polypropylene can be used. As an anti-caking agent, hydrophobic silica, inorganic oxides, or a spherical fine resin particle of PMMA, Teflon or styrene can be used.

The hydrophobic silica useful in this invention may be prepared by treating a vapor phase-treated silica (namely, fine silica which can be obtained by subjecting silicon chloride to a high temperature (flame) hydrolysis ) with a silane such as dimethyl dichlorosilane, and then capping the silanol groups exposed on the surface of silica with organosilane. Therefore, this hydrophobic silica exhibits more excellent high temperature hydrophobic nature as compared with the ordinary vapor phase-treated silica, and therefore when toner particles is added with this hydrophobic silica, it will give a developing agent which is excellent in moisture resistance and storage property.

Examples of the organic silicon compound useful in such a treatment for providing hydrophobic nature, the following compounds can be employed. Namely, hexamethyl disilazine, trimethyl silane, triethylethoxy silane, triorganosilyl mercaptan, trimethylsilyl mercaptan, triorganosilyl acrylate, vinyldimethylacetoxy silane, dimethylethoxy silane, dimethyldimethoxy silane, hexamethyl disiloxane, 1,3-divinyltetramethyl disiloxane or 1,3-diphenyltetramethyl disiloxane may be employed. Additionally, polydimethyl siloxane which comprises 2 to 12 siloxane units including a terminal siloxane unit having a hydroxyl group combined to its each Si atom can be used. Further, silicone oil and silicone varnish may also be used. These compounds may be used singly or in combination.

Additionally, it is also possible according to this invention to use other inorganic oxides other than the above mentioned hydrophobic silica to obtain substantially the same effects. Examples of such inorganic oxides are alumina, titania, zirconia and magnesia.

As explained above, it is possible according to this invention to obtain a developing agent which is capable of inhibiting the generation of fogging on a photosensitive drum even under a high temperature and high moisture conditions, since the distribution in particle size of the developing agent is regulated to a prescribed range according to this invention.

Moreover, since two kinds of silica differing in particle size are added to this toner particles having a regulated range of distribution in particle size, it has become possible to obtain a developing agent which is excellent in solid fidelity of image while inhibiting the fogging on a photosensitive drum.

Additional advantages and modifications will readily occur to those skilled in the art. Therefore, the invention in its broader aspects is not limited to the specific details, representative material, and illustrated examples shown and described herein. Accordingly, various modifications may be made without departing from the spirit or scope of the general inventive concept as defined by the appended claims and their equivalents.

What is claimed is:

1. A developing method which comprises feeding a one-component developing agent comprising toner particles containing a resin binder, a colorant, and silica particles, onto a developing means provided so as to face a photoreceptor on which an electrostatic latent image is formed, frictionally charging said developing agent by a developing agent layer-regulating member provided so as to contact with said developing agent fed on said developing means in the feeding step, thereby forming a charged developing agent layer on said developing means, and developing said latent image by supplying the latent image with the charged developing agent layer formed in said charging step, wherein said toner particles include first particles which have diameters of 5 μm or less and which account for less than 10% by number of all particles, and second particles which have diameters of 20 μm or more and which account for less than 0.5% by weight, and wherein a weight average standard deviation of the diameters of the toner particles is 2.5 μm or less, and wherein said silica particles comprise first silica particles having an average primary particle diameter ranging from 6 nm to less than 18 nm and second silica particles larger than the average primary particle diameter of the first silica particle, having an average primary particle diameter ranging from 18 nm to less than 46 nm, and wherein the total amount of the first silica particles and the second silica particles is 0.4 part by weight to 1.5 parts by weight per 100 parts by weight of said toner particles.

2. A developing method according to claim 1, wherein said developing agent is a non-magnetic single-component developing agent.

3. A developing method according to claim 1, wherein the weight average particle diameter of said toner particles is 12 μm or less.

4. A developing method according to claim 1, wherein the mixing ratio of the first silica particles to the second silica particles is 1:8 to 8:1.

5. A developing method according to claim 4, wherein the mixing ratio of the first silica particles to the second silica particles is 1:5 to 5:1.

6. A developing method according to claim 1, wherein the resin binder comprises polyester resin and the colorant comprises carbon black.

7. A developing method according to claim 1, wherein the toner particles comprises a charge control agent.

8. A developing method according to claim 1, wherein the silica particles are hydrophobic silica particles.

9. The developing method according to claim 1, which is a non-magnetization single component developing process.

10. The developing method according to claim 1, wherein said developing agent layer-regulating member is a blade provided in contact with said developing means.

11. A one-component developing agent comprising toner particles containing a resin binder, a colorant, and silica particles, wherein said toner particles include first particles which have diameters of 5 μm or less and which account for less than 10% by number of all particles, and second particles which have diameters of 20 μm or more and which account for less than 0.5% by weight, and a weight average standard deviation of the diameters of the toner particles is 2.5 μm or less, wherein said silica particles comprising first silica particles having an average primary particle diameter ranging from 6 nm to less than 18 nm and second silica particles larger than the average primary particle diameter of the first silica particle, having an average primary particle diameter ranging from 18 nm to less than 46 nm, and wherein the total amount of the first silica particles and the second silica particles is 0.4 part by weight to 1.5 parts by weight per 100 parts by weight of said toner particles.

12. A developing agent according to claim 11, wherein said developing agent is a non-magnetic single-component developing agent.

13. A developing agent according to claim 11, wherein the weight average particle diameter of said toner particles is 12 μm or less.

14. A developing agent according to claim 11, wherein the mixing ratio of the first silica particles to the second silica particles is 1:8 to 8:1.

15. A developing agent according to claim 11, wherein the mixing ratio of the first silica particles to the second silica particles is 1:5 to 5:1.

16. A developing agent according to claim 11, wherein the resin binder comprises polyester resin and the colorant comprises carbon black.

17. A developing agent according to claim 11, wherein the toner particles comprises a charge control agent.

18. A developing agent according to claim 11, wherein the silica particles are hydrophobic silica particles.

* * * * *